US012752164B2

(12) United States Patent
Woolen

(10) Patent No.: US 12,752,164 B2
(45) Date of Patent: Oct. 6, 2026

(54) FILL MATERIAL DISPENSER

(71) Applicant: Trisha Woolen Investments Inc., Indio, CA (US)

(72) Inventor: Trisha Woolen, La Quinta, CA (US)

(73) Assignee: Trisha Woolen Investments Inc.

( * ) Notice: Subject to any disclaimer, the term of this patent is extended or adjusted under 35 U.S.C. 154(b) by 447 days.

(21) Appl. No.: 18/351,127

(22) Filed: Jul. 12, 2023

(65) Prior Publication Data

US 2025/0018263 A1 Jan. 16, 2025

(51) Int. Cl.

| | |
|---|---|
| ***A63B 57/50*** | (2015.01) |
| ***B65D 1/02*** | (2006.01) |
| ***B65D 41/04*** | (2006.01) |
| ***B65D 47/06*** | (2006.01) |
| ***B65D 83/06*** | (2006.01) |

(52) U.S. Cl.

CPC ..... *A63B 57/50* (2015.10); *B65D 1/0207* (2013.01); *B65D 1/0246* (2013.01); *B65D 1/0284* (2013.01); *B65D 41/04* (2013.01); *B65D 47/06* (2013.01); *B65D 83/06* (2013.01)

(58) Field of Classification Search

CPC .... A63B 57/50; B65D 1/0207; B65D 1/0246; B65D 1/0284; B65D 41/04; B65D 47/06; B65D 83/06

See application file for complete search history.

(56) References Cited

U.S. PATENT DOCUMENTS

| | | | | |
|---|---|---|---|---|
| 5,042,759 | A * | 8/1991 | Blair | A01K 5/0142 220/228 |
| 5,499,730 | A * | 3/1996 | Harbour | B65D 1/0223 220/675 |
| 5,784,972 | A * | 7/1998 | Emalfarb | A47G 7/041 248/150 |
| 5,810,195 | A * | 9/1998 | Sim | B65D 51/20 220/675 |
| 6,267,269 | B1 | 7/2001 | Kates | |
| 6,694,671 | B2 * | 2/2004 | Vahrmeyer | A47G 7/06 47/65.5 |
| 6,739,486 | B2 * | 5/2004 | Winkler | B60J 7/10 222/608 |
| 6,841,262 | B1 * | 1/2005 | Beck | B29C 49/071 220/675 |
| 6,920,992 | B2 * | 7/2005 | Lane | B65D 79/0084 215/381 |
| 7,032,770 | B2 * | 4/2006 | Finlay | B65D 1/44 220/675 |
| 7,080,747 | B2 * | 7/2006 | Lane | B65D 79/0084 215/381 |

(Continued)

FOREIGN PATENT DOCUMENTS

| | | | | |
|---|---|---|---|---|
| DE | 3700950 | A1 * | 10/1987 | A61B 50/36 |
| FR | 2831477 | A1 * | 5/2003 | B25C 3/006 |

*Primary Examiner* — Frederick C Nicolas

(74) *Attorney, Agent, or Firm* — AEON Law, PLLC; Adam L.K. Philipp; James Namiki

(57) ABSTRACT

A dispenser to dispense a fill material is disclosed. The dispenser includes a spout cap having a dispensing opening to dispense the fill material, and a bottle member with a closed bottom and a top end opposite of the closed bottom, the top end of the bottle member to mate with the spout cap, and extending downward from the outer surface of the closed bottom of the bottle member are a plurality of spikes.

14 Claims, 12 Drawing Sheets

(56) References Cited

U.S. PATENT DOCUMENTS 7,156,269 B1 * 1/2007 Meyer ..... A63B 57/50 222/568
7,178,687 B1 * 2/2007 Manderfield, Jr. ..... B65D 1/10 220/675
7,216,785 B1 * 5/2007 Meyer ..... B65D 47/06 222/568
7,377,399 B2 * 5/2008 Lane ..... B65D 79/0084 215/381
7,490,805 B2 * 2/2009 Krall ..... A63B 57/50 215/396
7,971,760 B1 * 7/2011 Winkler ..... A01C 15/02 220/23.91
8,118,182 B1 * 2/2012 Licari ..... A45F 3/20 220/717
8,215,167 B2 * 7/2012 Hall ..... G01F 19/002 73/426
8,602,237 B2 * 12/2013 Wurster ..... B65D 1/42 220/675
8,733,568 B2 * 5/2014 Dunn ..... A47G 19/2266 215/331
8,979,410 B2 * 3/2015 Massimi ..... A46B 11/0041 401/185
D736,091 S * 8/2015 Toms ..... D9/551
D815,914 S * 4/2018 Mesalic ..... A47G 19/2227 D7/532
D864,724 S * 10/2019 Pinard ..... B65D 1/0223 D9/545
2002/0056728 A1 * 5/2002 Winkler ..... B60J 7/10 222/175
2004/0129731 A1 7/2004 Hahn
2005/0247664 A1 * 11/2005 Lane ..... B65D 1/42 215/381
2007/0210227 A1 * 9/2007 Krall ..... A63B 57/50 248/311.2
2008/0110853 A1 * 5/2008 Toms ..... B65D 23/085 215/383
2009/0288965 A1 * 11/2009 Greenberg ..... B65D 81/3211 206/222
2012/0153100 A1 * 6/2012 Sakairi ..... B01D 35/30 248/176.3
2016/0271341 A1 * 9/2016 Chanie ..... A61M 5/422
2017/0369216 A1 * 12/2017 Sezanayev ..... B65D 43/0231
2023/0014914 A1 * 1/2023 Nguyen ..... B65D 1/0223
2023/0078750 A1 * 3/2023 Smith ..... B65D 25/38 220/254.1
2025/0297926 A1 * 9/2025 Gill ..... G01N 1/2035

* cited by examiner

FILL MATERIAL DISPENSER

FIELD

The present disclosure relates to a portable dispenser for dispensing fill material into, for example, divot holes on golf courses.

BACKGROUND

In golfing, golfers often create divot holes when they swing their golf club to strike a golf ball on a fairway. It is generally considered proper etiquette for golfers to put back the divots into the divot holes they create or to fill the divot holes with fill material, which may comprise of sand, a sand and seed mixture, or other types of fill material or mixtures. In fact, many golf courses request that golfers, as a general rule, fill divot holes that they create during play.

Consequently, many golf courses provide dispensers for dispensing fill material. The dispensers provided by golf courses are typically placed on golf carts and can be large and heavy, which can be an issue at times. That is, in some situations, golf carts are restricted from being driven onto certain portions of fairways (e.g., golf carts are typically not allowed to be driven near the greens). Thus, carrying these large dispensers to where divot holes are formed can be very inconvenient, particularly if the golfer is also carrying multiple clubs as is often the case when the golfer's ball is located well away from the cart path. There has been minimal advancement in dispenser design in recent years, thus, conventional dispensers tend to be fairly simple with minimal functionalities such as only the ability to dispense fill material without much more.

SUMMARY

Figure 1:
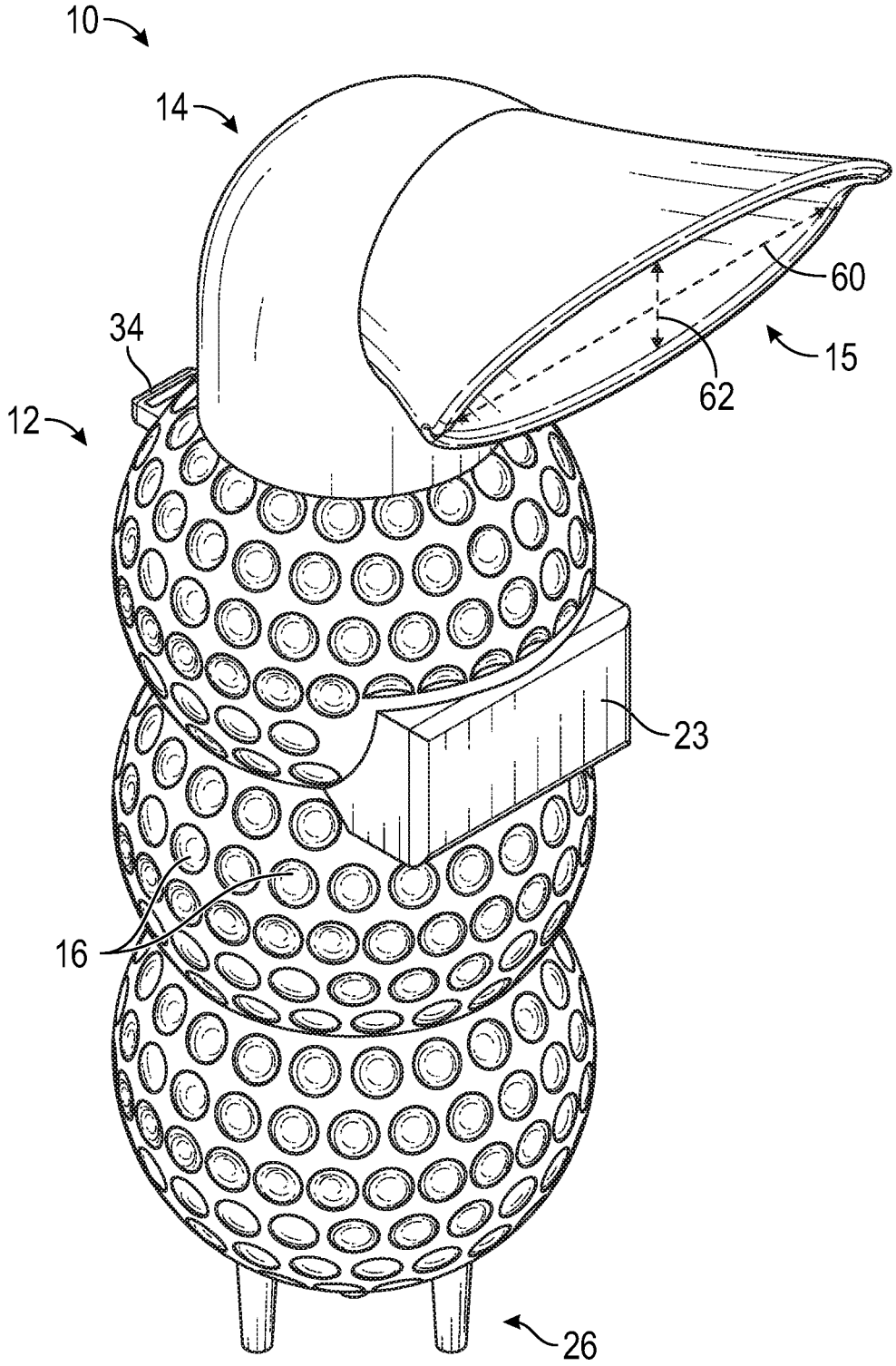
FIG. 1 illustrates an example fill material dispenser according to some example embodiments.

Various embodiments of the present disclosure provide for a fill material dispenser for dispensing a fill material. For these embodiments, the fill material dispenser may comprise a bottle member with a cavity to hold the fill material and having an open top and a closed bottom opposite of the open top, a plurality of spikes extending downward from the closed bottom, and a spout cap to mate with the open top of the bottle member, the spout cap having a dispensing opening and a spout cap opening that is opposite from the dispensing opening, the spout cap opening to mate with the open top of the bottle member.

In some embodiments, the bottle member may include multiple stacked bulb shapes. For these embodiments, the bottle member may include three stacked bulb shapes that are stacked atop each other, a top bulb shape, a middle bulb shape, and a bottom bulb shape, the top bulb shape includes the open top of the bottle member.

In some embodiments, at least a portion of an outer surface of the bottle member has dimples. In at least some of these embodiments, at least a portion of the dimples are evenly spaced apart on the at least the portion of the outer surface of the bottle member. In some cases, the dimples may have circular shapes.

In various embodiments, the plurality of spikes may include five spikes, four of the five spikes may be located at four corners of a square, and the fifth of the five spikes located at center of the square. For these embodiments, the five spikes may have longitudinal lengths such that the ends of the five spikes end on a lateral plane. In some embodiments, the plurality of spikes may include a plurality of flat-tipped spikes.

In some embodiments, the spout cap may be a twist cap. In some embodiments, the spout cap is an L-shaped spout cap that partially extends perpendicular to a longitudinal axis of the bottle member when the spout cap and the bottle member are mated. In some embodiments, the dispensing opening and the spout cap opening are at opposite ends of the L-shaped spout cap. In some embodiments, the bottle member at least partially encloses a cavity to hold the fill material. In some embodiments, the dispensing opening is a wide mouth dispensing opening with a width and a height, where the width is at least three times the height. For these embodiments, the width may be 4.02 inches and the height may be 1.12 inches.

DETAILED DESCRIPTION

In the present description, certain specific details are set forth in order to provide a thorough understanding of various embodiments of the disclosure. However, upon reviewing this disclosure one skilled in the art will understand that the various embodiments disclosed herein may be practiced without many of these details. In other instances, some well-known structures and materials of construction have not been described in detail to avoid unnecessarily obscuring the descriptions of the embodiments of the disclosure.

In the present disclosure, to the extent the terms "about" and "approximately." are used, they mean±20% of the indicated range, value, or structure, unless otherwise indicated. In the present description, the terms "a" and "an" as used herein refer to "one or more" of the enumerated components. The use of the alternative (e.g., "or") should be understood to mean either one, both, or any combination thereof of the alternatives. As used herein, the terms "include" and "comprise" are used synonymously, the terms and variants of which are intended to be construed as non-limiting. The definitions in this paragraph are intended to apply throughout this disclosure unless otherwise expressly stated.

According to various embodiments of the present disclosure, a portable fill material dispenser (hereinafter "fill material dispenser") is disclosed that may be used to fill, for example, divot holes in golf course fairways. The fill material dispenser may be compact and may have useful features that make it easier to hold and carry the portable fill material dispenser and to facilitate the proper filling of divot holes. For example, in some embodiments, the entire longitudinal length of the fill material dispenser, which as will be further described herein may include a spout cap, a bottle member, and spikes, may be less than 12 inches (e.g., 10.81 inches) and a bottle member width excluding the spout cap of less than 3.5 inches (e.g., 3.48 inches). As will be further illustrated and described herein, the fill material dispenser may have an outer surface and shape that facilitates a user to firmly grip the fill material dispenser, and spikes to tap down the fill material once it is dispensed into, for example, divot holes, as well as to perform other functionalities.

FIG. 1 illustrates an example portable fill material dispenser 10 according to various example embodiments. The fill material dispenser 10 includes a bottle member 12, a spout cap 14, and spikes 26 that extend downwards from the bottom of the bottle member 12. For these embodiments, the spout cap 14 may be L-shaped as more clearly shown in FIG. 3 with a dispensing opening 15 through which a fill material may be dispensed through. As will be further illustrated in FIG. 2, the spout cap 14 and the spout cap 14 are separable components that may be mated to form the fill material dispenser 14. The dispensing opening 15 of the L-shaped spout cap 14 may be located at an opposite end of the spout cap 14 from a spout cap opening 33 (see FIG. 2).

Figure 3:
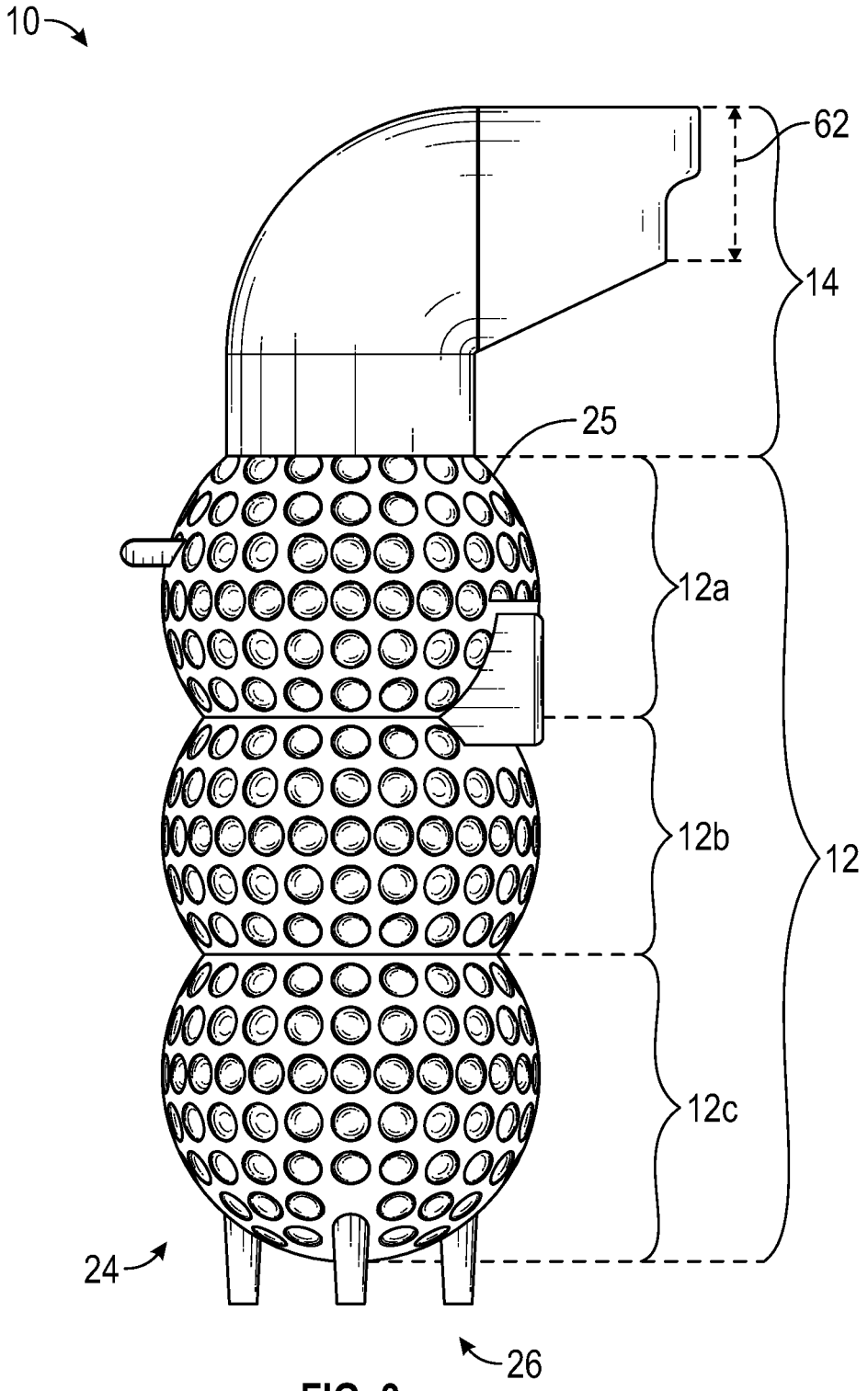
FIG. 3 is a side view of the fill material dispenser of FIG. 1 according to some example embodiments.
Figure 5:
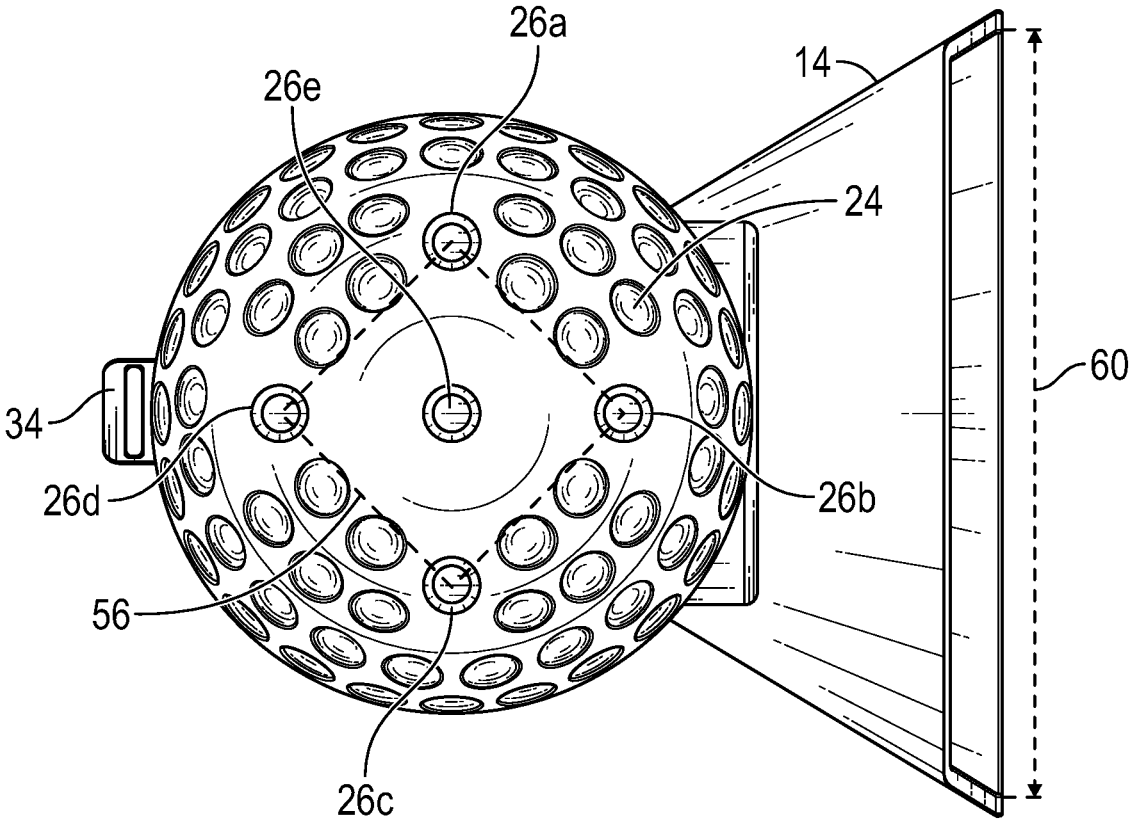
FIG. 5 is a bottom view of the fill material dispenser of FIG. 1 according to some example embodiments.
Figure 6:
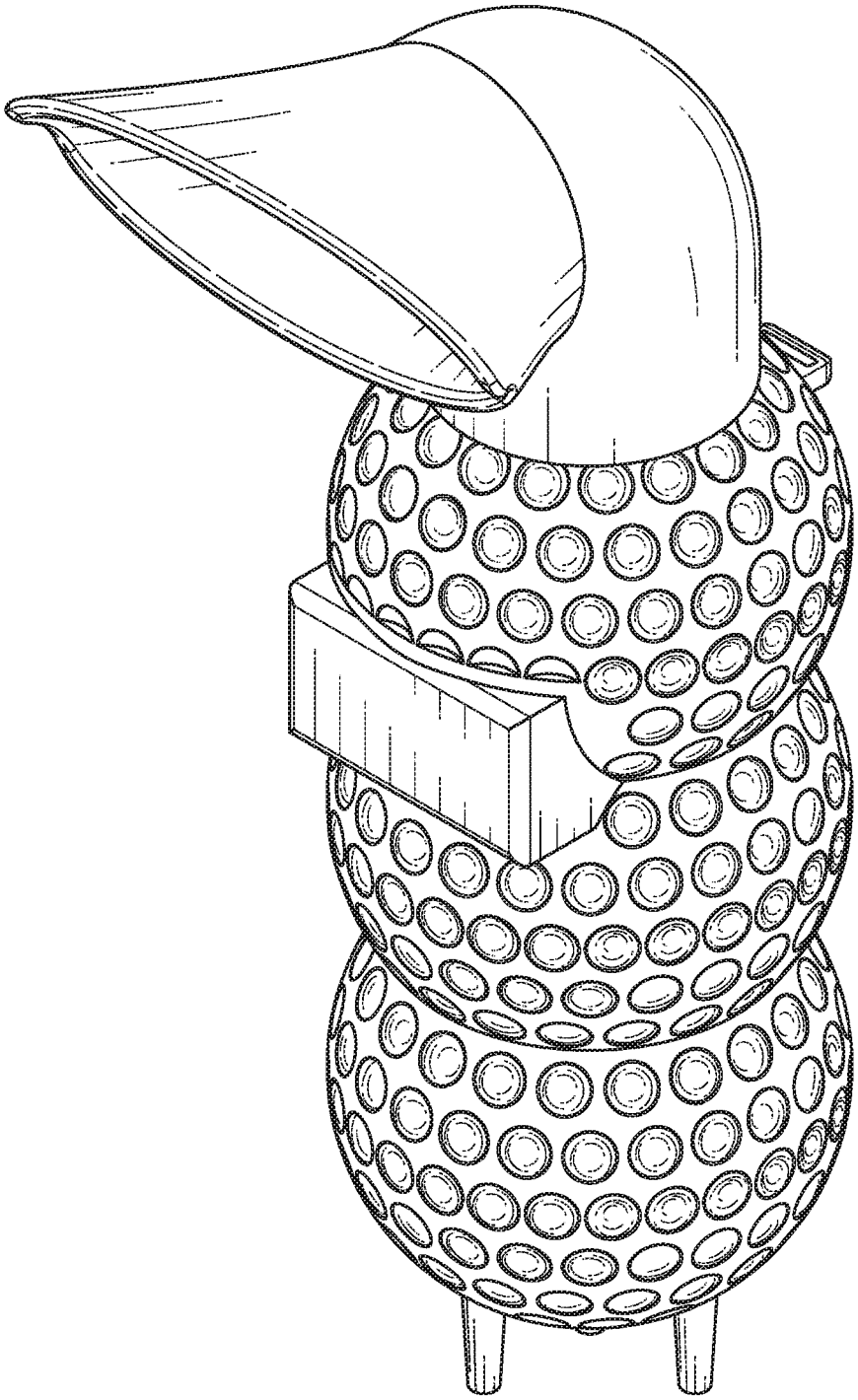
FIG. 6 is a top-front-left perspective view of an example embodiment of a fill material dispenser.
Figure 7:
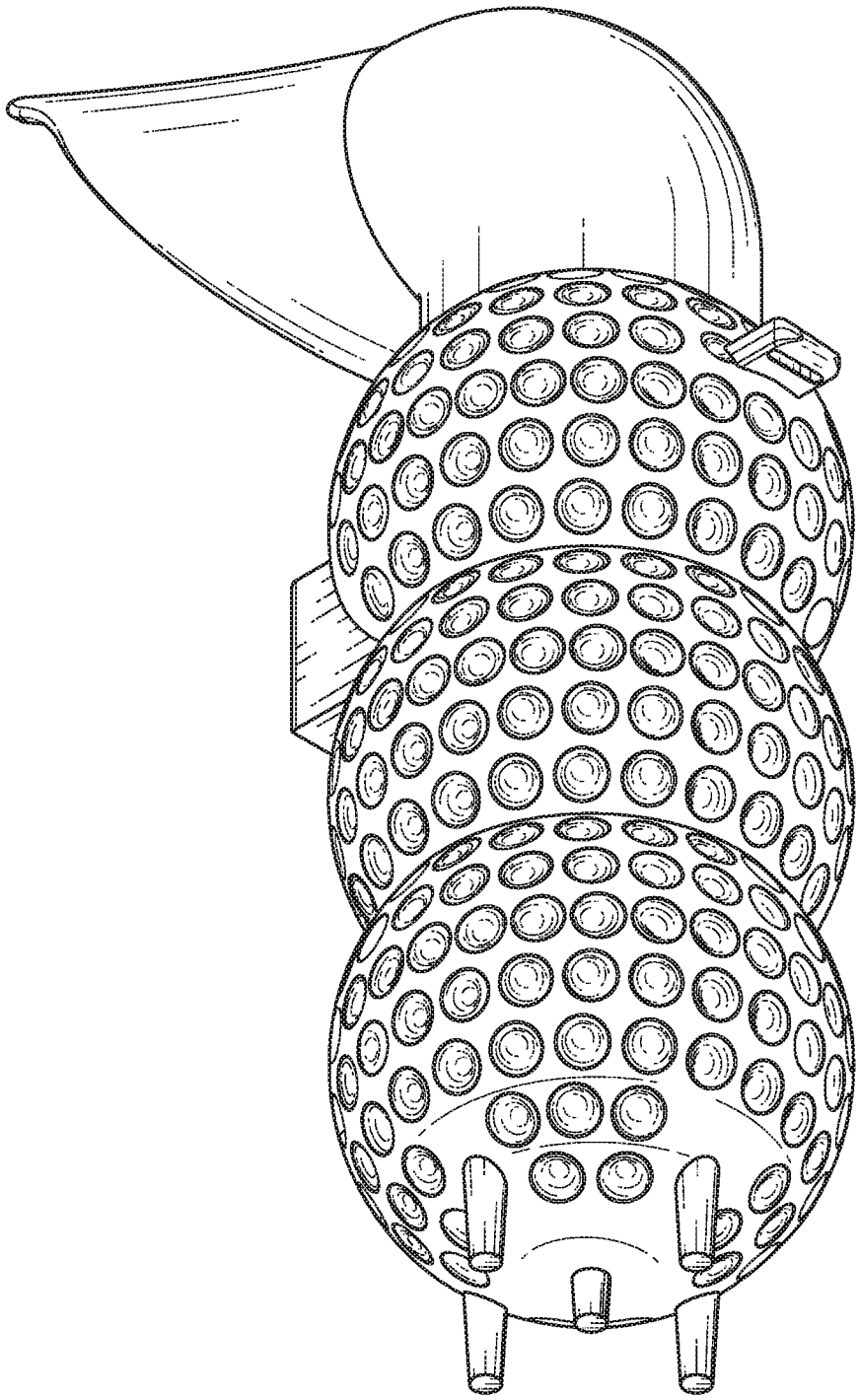
FIG. 7 is a bottom-rear-left perspective view thereof.
Figure 8:
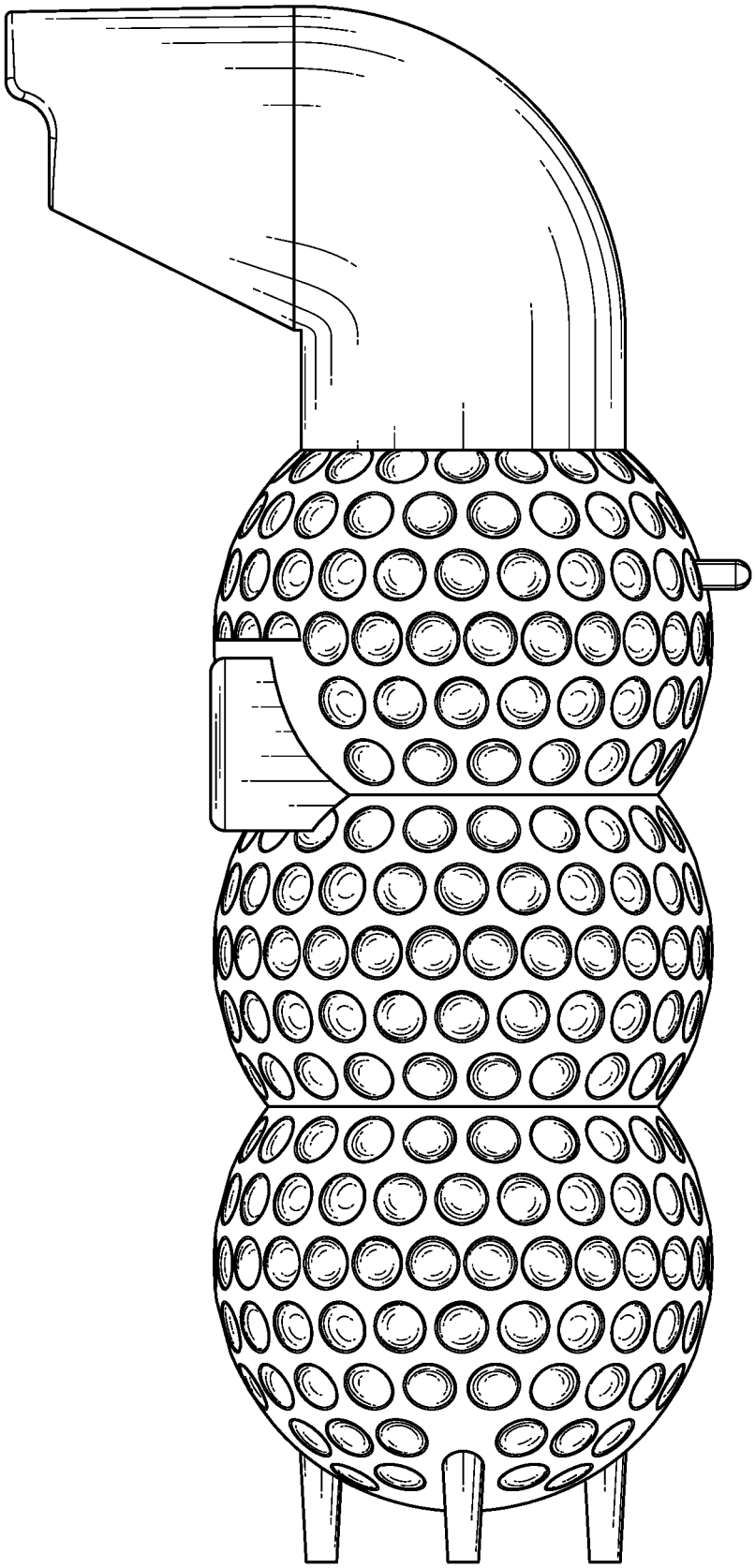
FIG. 8 is a left side elevation view thereof.
Figure 9:
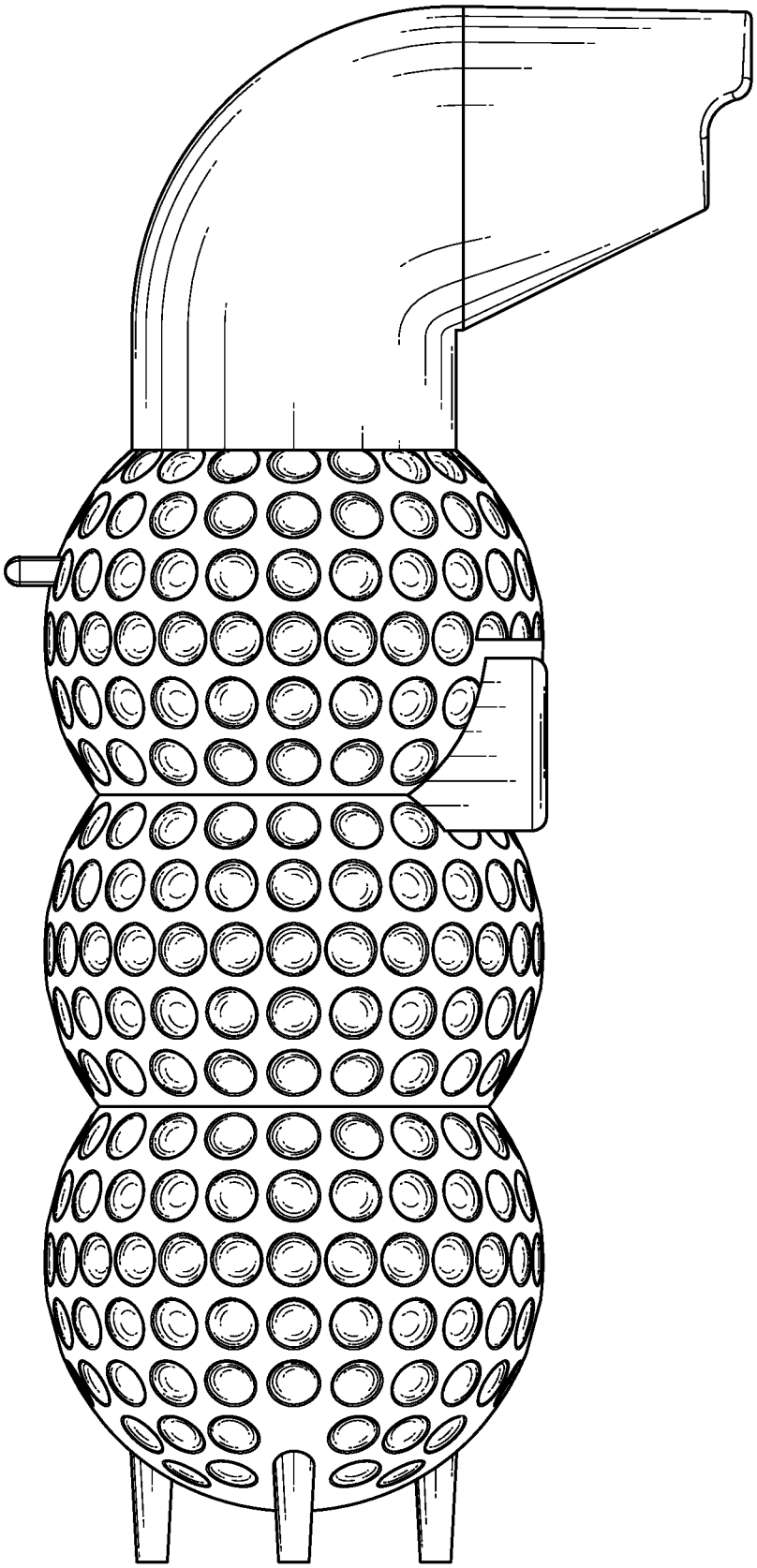
FIG. 9 is a right side elevation view thereof.
Figure 10:
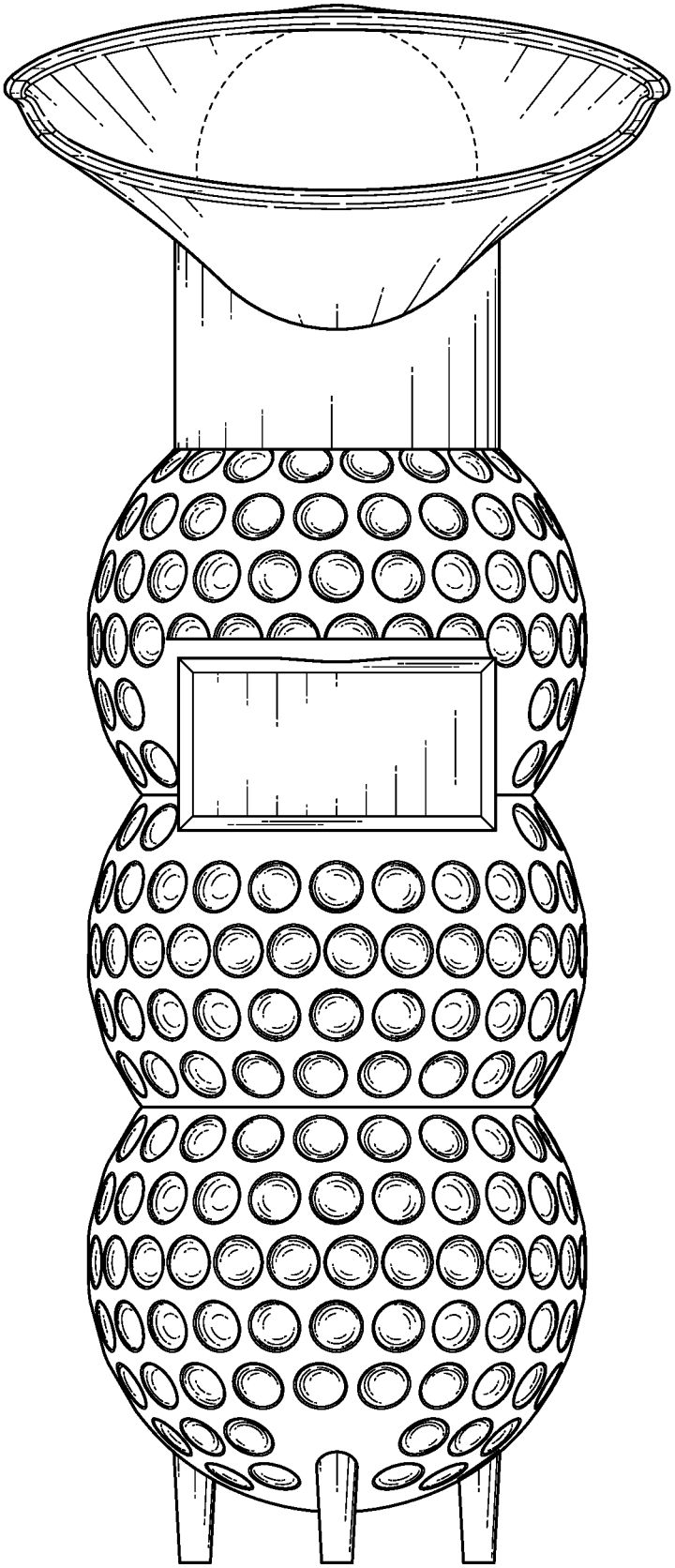
FIG. 10 is a front elevation view thereof.
Figure 11:
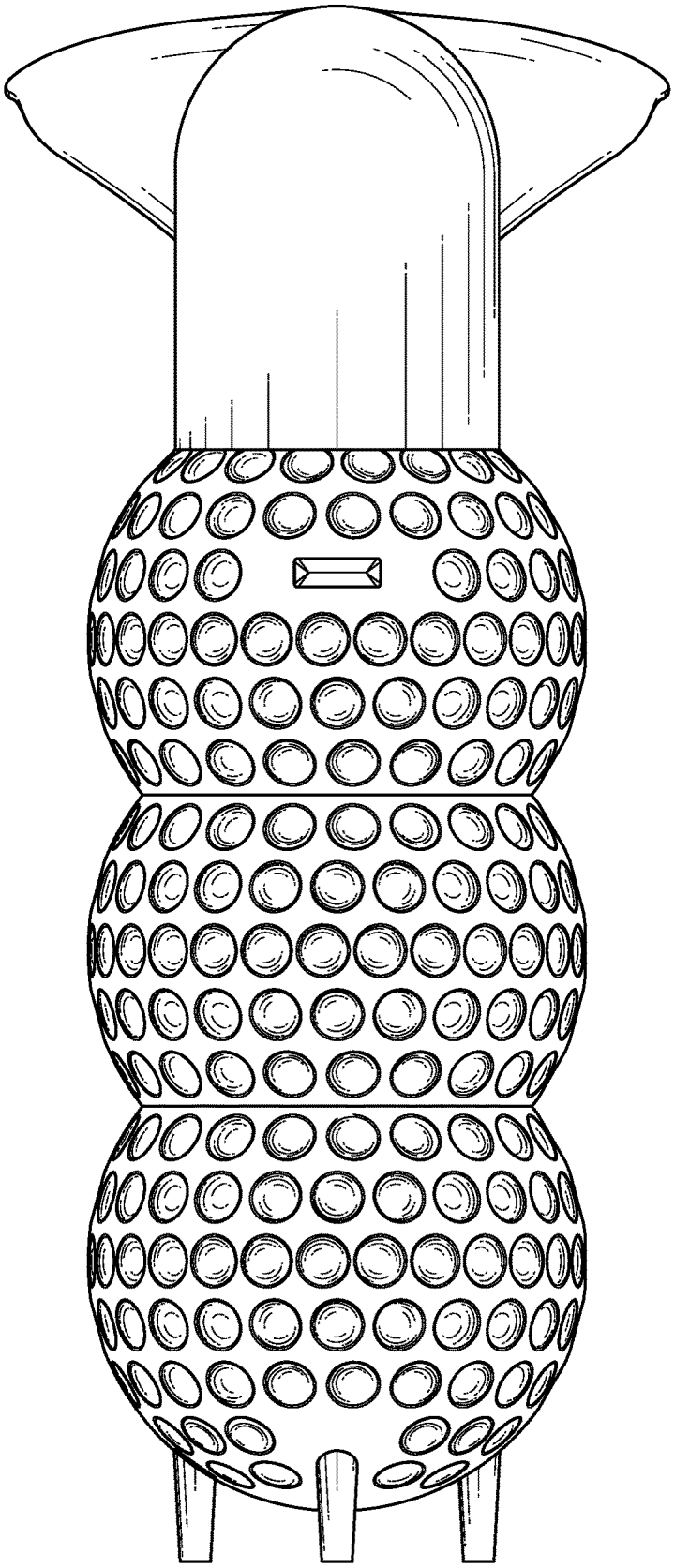
FIG. 11 is a back elevation view thereof.
Figure 12:
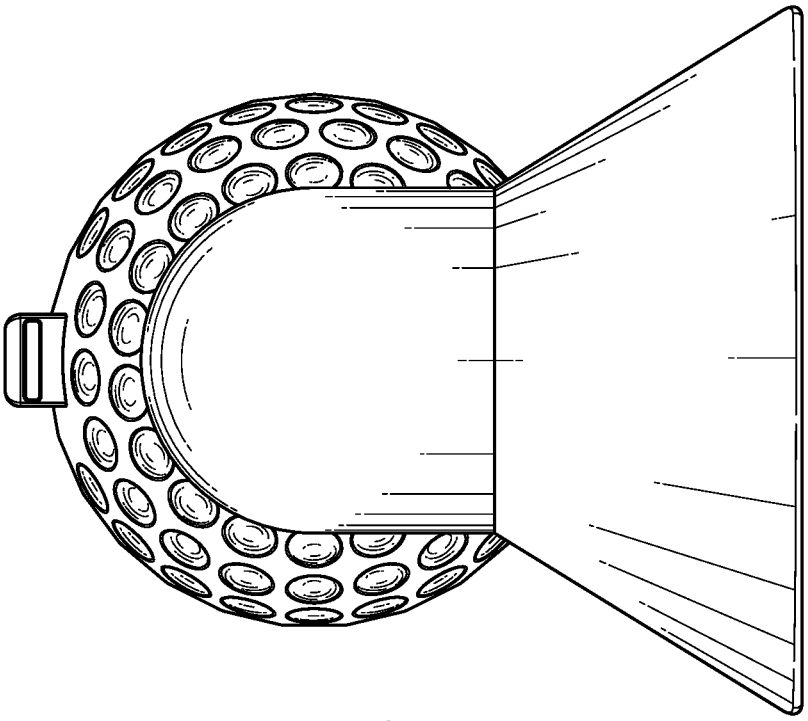
FIG. 12 is a top plan view thereof.
Figure 13:
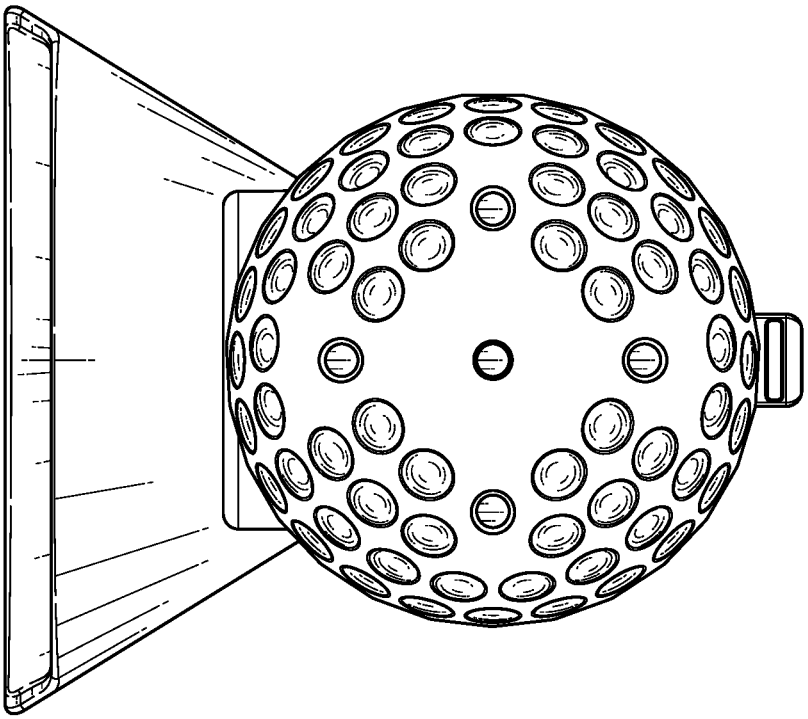
FIG. 13 is a bottom plan view thereof.

In various embodiments, the dispensing opening 15 may be a wide-mouth opening in which the width 60 of the dispensing opening 15 is substantially longer or wider than the height 62 of the dispensing opening 15 (see FIGS. 3 and 5 that more clearly show the height 62 and width 60 of the dispensing opening as well as FIG. 10, which shows the front view of the dispensing opening 15). For example, in one embodiment, the dispensing opening 15 may have a width 60 that is three times the height 62 of the dispensing opening 15 such as a width 60 of about 4.02 inches and a height 62 of about 1.12 inches. In other embodiments, however, the dispensing opening 15 may have other shape types.

Within the spout cap 14 and the bottle member 12 is a cavity 50 (see FIG. 4) for holding fill material (e.g., sand, soil, sand and seed mixture, or other materials or mixtures). The bottle member 12 includes three stacked bulb shapes, and an outer surface with dimples 16, which may be circular notches or dents as illustrated in FIG. 1. In alternative embodiments, the dimples 16 may have other shape types such as oval, triangle, rectangular, square, and so forth. The bulb shapes 12*a*, 12*b*, and 12*c* (see FIG. 3), and the dimples 16 may help a golfer to maintain a firm grip on the fill material dispenser 10 while walking through, for example, a golf course fairway.

The spikes 26 at the bottom of the bottle member 12 may extend downwards from the bottom of the bottle member 12 and in some cases may be flat-tipped spikes. As noted above, the spikes 26 may be used to tap down, for example, fill material that has been dispensed into a divot hole. In some cases, spikes 26 may also be used to remove any unwanted turf in a divot hole before the divot hole is filled with fill material. In still other cases, the spikes 26 may be used to tap down a divot into the divot hole.

Disposed on the upper side of the bottle member 12 is strap attachment 34 for running a strap through. As illustrated, the strap attachment 34 includes a rounded rectangular hole. In alternative embodiments, however, the hole may have other shape types. In some embodiments, a label surface 23 for affixing or forming a label may be disposed on the outer surface of the bottle member 12.

Figure 2:
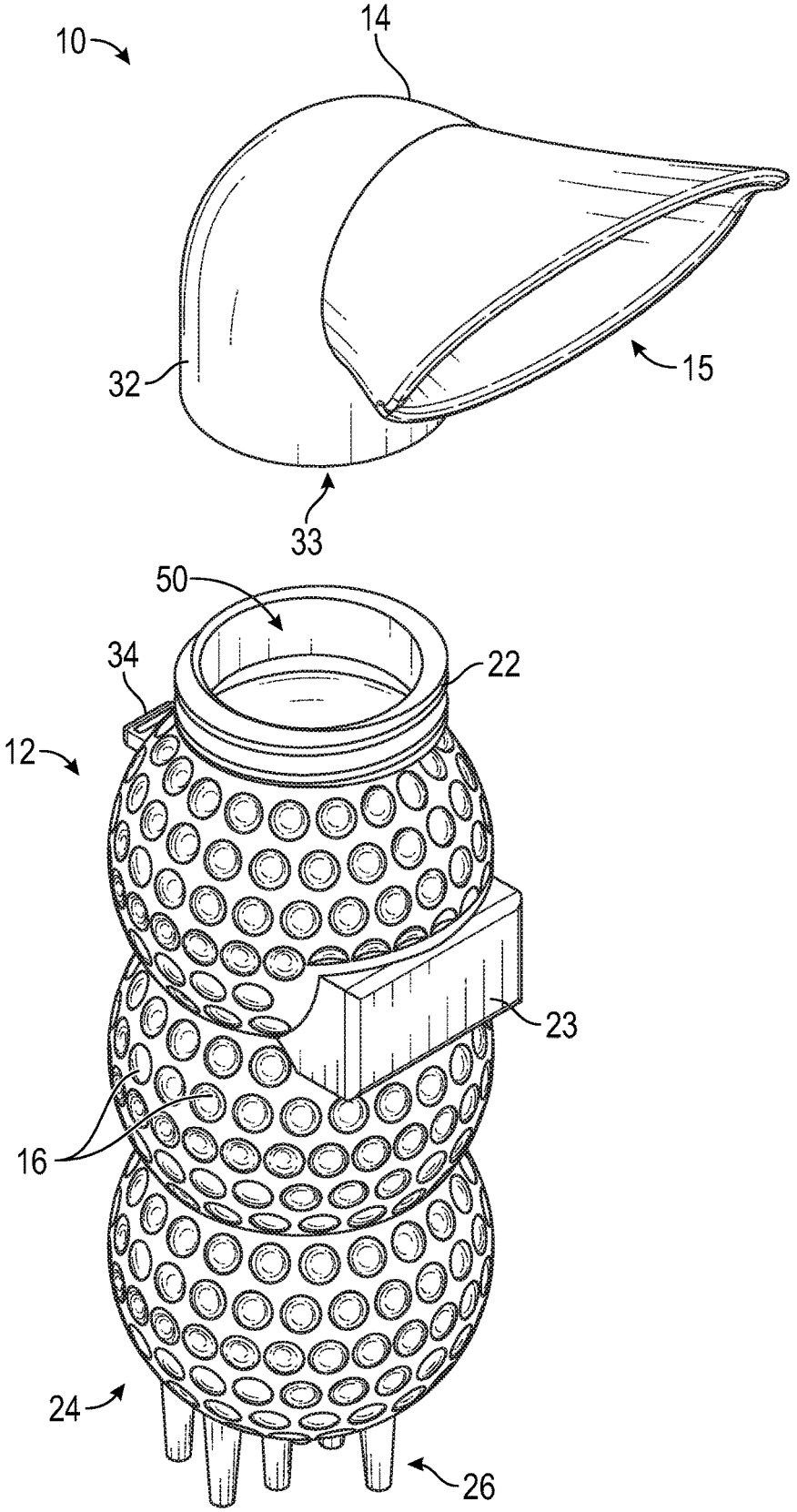
FIG. 2 illustrates the example fill material dispenser of FIG. 1 when two separable components of the fill material dispenser, a bottle member and a spout cap, are separated according to some example embodiments.

In various embodiments, the spout cap 14 and the bottle member 12 may be separate components that may be mated as illustrated in FIG. 2. The bottle member 12 includes a cavity 50, an open top 22, and a closed bottom 24 opposite of the open top 22. The plurality of spikes 26 extends downwards from the closed bottom 24. In some embodiments, and as illustrated in FIG. 2, the open top 22 includes threads that the spout cap 14, which may be a twist cap, can be screwed onto. In the embodiment illustrated in FIG. 2, the open top 22 of the bottle member 12 includes male threads while an interior side (not shown) of a spout cap opening 33 of the spout cap 14 includes female threads for mating the spout cap 14 to the bottle member 12. Note that in alterative embodiments, the spout cap 14 and the bottle member 12 may be mated using other means (e.g., clamp[s], hinge[s], etc.). As shown in FIG. 2, the bottle member 12 includes a label surface 23 that may be used to affix/form labels or logos.

The spout cap 14 includes the dispensing opening 15 that is connected to a spout base 32, which includes the spout cap opening 33 for mating with the open top 22 of the bottle member 12. Note that in FIG. 1, the bottle member 12 includes three bulb shapes 12*a*, 12*b*, and 12*c* (see FIG. 3) that are stacked on top of each other. In some alternative embodiments, the spout cap 14 may include at least a portion of the topmost bulb shape 12*a*, in which case the mating point/line of the maintain container body 12 and the spout cap 14 will be located somewhere along the topmost bulb shape 12*a*. In still other embodiments, the spout cap 14 may include the entire uppermost bulb shape 12*a*.

In the embodiment illustrated in FIG. 2, the bottle member 12 further includes the strap attachment 34 and the label surface 23. Note that although in the embodiment illustrated in FIG. 2 the strap attachment 34 and the label surface 23 are disposed on the bottle member 12, the strap attachment 34 and the label surface 23 may be located at other locations of the fill material dispenser 10 in alternative embodiments such as on the spout cap 14. For example, in one alternative embodiment, the label surface 23 may be located on the spout cap 14 rather than on the bottle member 12. Similarly, rather than being placed on the bottle member 12 as illustrated in FIG. 2, the strap attachment 34 may alternatively be placed on the spout cap 14. In still other embodiments, the strap attachment 34 and/or the label surface 23 may be omitted. Note that although only the bottle member 12 is illustrated as having exterior or outer surfaces covered with dimples 16, in alternative embodiments, at least a portion of the spout cap 14 may also have exterior or outer surfaces covered with dimples 16. In various embodiments, these dimples 16 may be indentations or dents that may each be circular. In various embodiments, at least a portion of the dimples 16 may be evenly spaced apart on at least portions of the outer surfaces of the bottle member 12 (e.g., may be generally or substantially evenly spaced apart on longitudinal outer surfaces of the bottle member 12). In one example embodiment, the dimples 16 may have a diameter of 0.372 (approximately ⅓) inch, and may have a depth of 0.196 (approximately 3⁄16) inch.

FIG. 3 is a side view of the fill material dispenser 10 of FIG. 1 according to some example embodiments. More particularly, FIG. 3 more clearly shows, among other things, the relationship between the two separable components, the spout cap 14 and the bottle member 12. The bottle member 12, as previously indicated, includes three stacked bulb shapes including an uppermost or top bulb shape 12*a*, a middle bulb shape 12*b*, and a bottom bulb shape 12*c*. The bottle member 12 includes a top end 25 (which is the top of the top bulb shape 12*a*) and a closed bottom 24 opposite of the top end 25. Extending down from the closed bottom 24 of the bottle member 12, which is also the bottom of the bottom bulb shape 12*c*, are spikes 26. In various embodiments, the bottle member 12 at least partially encloses a cavity 50 (see FIG. 4) for holding a fill material.

Figure 4:
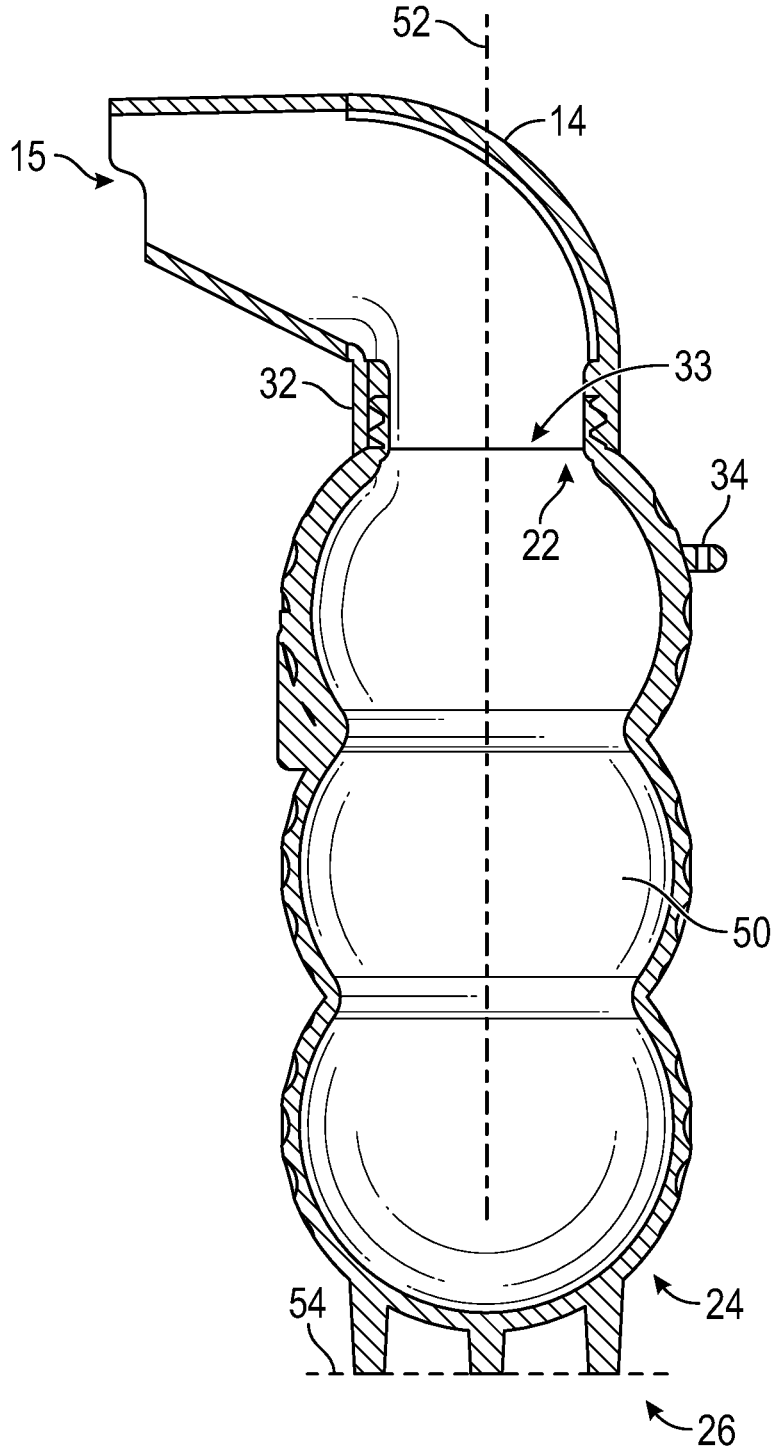
FIG. 4 is a cross-sectional view of the fill material dispenser of FIG. 1 according to some example embodiments.

FIG. 4 is a cross-sectional view of the fill material dispenser 10 of FIG. 1 according to some example embodiments. As previously described, the fill material dispenser 10 may comprise two separable or mateable components, a bottle member 12 and a spout cap 14, which when mated/combined will form the fill material dispenser 10. More particularly, at the bottom of the spout cap 14 is a spout cap opening 33 that may be mated to the open top 22 of the bottle member 12.

In various embodiments, the spout cap 14 comprises an L-shaped spout that partially extends perpendicular or orthogonally to a longitudinal axis 52 of the bottle member 12. The plurality of spikes 26, which may be flat-tipped spikes, may extend downwards from the closed bottom 24 of the bottom member 20 and may have longitudinal lengths such that the ends of the spikes 26 end on a lateral plane 54. By having such a configuration, the fill material dispenser 10 may stand upright when placed on a flat surface.

FIG. 5 is a bottom view of the fill material dispenser 10 of FIG. 1 according to some example embodiments. Extending downward from the closed bottom 24 of the bottle member 12 are five spikes 26*a*, 26*b*, 26*c*, 26*d*, and 26*c*. In various embodiments, four of the five spikes 26*a*, 26*b*, 16*c*, and 26*d* are located at four corners of a square 56, and the fifth spike 26*e* is located at the center of the square 56. In order to ensure that the ends of the spikes 26*a*, 26*b*, 26*c*, 26*d*, and 26*e* end on the same lateral plane 54, the spikes 26*a*, 26*b*, 26*c*, 26*d*, and 26*e* may have different lengths since the spikes 26*a*, 26*b*, 26*c*, 26*d*, and 26*e* extend downward from the bottom of the bottle member 12 that is rounded rather than flat. For example, since spike 26*e* extends downward from the lowest point of the bottle member 12, to ensure that all the spikes 26*a*, 26*b*, 26*c*, 26*d*, and 26*e* end on the same plane, spike 26*e* may be shorter than the other four spikes 26*a*, 26*b*, 26*c*, and 26*d*. In one embodiment, for example, spike 26*e* may have a length of approximately ¾ inch, while the other spikes 26*a*, 26*b*, 26*c*, and 26*d* may have a length of approximately 1 inch.

FIGS. 6-13 illustrate various views of an example embodiment of a fill material dispenser.

After reviewing the present disclosure, an individual of ordinary skill in the art will immediately appreciate that some details and features can be added, removed and/or changed without deviating from the spirit of the invention. Reference throughout this specification to "one embodiment," "an embodiment," "additional embodiment(s)," "various embodiments," or "some embodiments," means that a particular feature, structure or characteristic described in connection with the embodiment(s) is included in at least one or some embodiment(s), but not necessarily all embodiments, such that the references do not necessarily refer to the same embodiment(s). Furthermore, the particular features, steps, structures, or characteristics may be combined in any suitable manner in one or more embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A fill material dispenser, comprising:

a bottle member with a cavity to hold a fill material and having an open top and a closed bottom opposite of the open top, a plurality of spikes extending downward from an external surface of the closed bottom and away from the cavity; and a spout cap to mate with the open top of the bottle member, the spout cap having a dispensing opening and a spout cap opening that is opposite from the dispensing opening, the spout cap opening to mate with the open top of the bottle member;

wherein the bottle member includes multiple stacked bulb shapes.

2. The fill material dispenser of claim 1, wherein the bottle member has three stacked bulb shapes that are stacked atop of each other, a top bulb shape, a middle bulb shape, and a bottom bulb shape, the top bulb shape includes the open top of the bottle member.

3. The fill material dispenser of claim 1, wherein at least a portion of an outer surface of the bottle member has dimples.

4. The fill material dispenser of claim 3, wherein at least a portion of the dimples are evenly spaced apart on the at least the portion of the outer surface of the bottle member.

5. The fill material dispenser of claim 4, wherein the dimples have circular shapes.

6. The fill material dispenser of claim 1, wherein the plurality of spikes includes five spikes, four of the five spikes located at four corners of a square, and the fifth of the five spikes located at center of the square.

7. The fill material dispenser of claim 6, wherein the five spikes have longitudinal lengths such that ends of the five spikes end on a lateral plane.

8. The fill material dispenser of claim 1, wherein the plurality of spikes includes a plurality of flat-tipped spikes.

9. The fill material dispenser of claim 1, wherein the spout cap is a twist cap.

10. The fill material dispenser of claim 1, wherein the spout cap is an L-shaped spout cap that partially extends perpendicular to a longitudinal axis of the bottle member when the spout cap and the bottle member are mated.

11. The fill material dispenser of claim 10, wherein the dispensing opening and the spout cap opening are at opposite ends of the L-shaped spout cap.

12. The fill material dispenser of claim 1, wherein the bottle member at least partially encloses the cavity to hold the fill material.

13. The fill material dispenser of claim 1, wherein the dispensing opening is a wide-mouth dispensing opening with a width and a height, where the width is at least three times the height.

14. The fill material dispenser of claim 13, wherein the width is 4.02 inches and the height is 1.12 inches.

* * * * *